US006929518B1

(12) United States Patent
Sawyer et al.

(10) Patent No.: US 6,929,518 B1
(45) Date of Patent: Aug. 16, 2005

(54) METHOD FOR CONTROLLING A SHIFT PROCEDURE FOR A MARINE PROPULSION SYSTEM

(75) Inventors: Kass W. Sawyer, Neenah, WI (US); John A. Tuchscherer, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/731,716

(22) Filed: Dec. 9, 2003

(51) Int. Cl.[7] ..... B63H 20/14
(52) U.S. Cl. ..... 440/75; 440/1; 73/862.333
(58) Field of Search ..... 440/1, 75

(56) References Cited

U.S. PATENT DOCUMENTS

| | | | | |
|---|---|---|---|---|
| 4,262,622 | A | 4/1981 | Dretzka et al. | 440/1 |
| 4,432,734 | A | 2/1984 | Bland et al. | 440/1 |
| 4,753,618 | A | 6/1988 | Entringer | 440/86 |
| 4,762,008 | A | 8/1988 | Kobayashi et al. | 73/862.36 |
| 5,052,958 | A | 10/1991 | Entringer et al. | 440/75 |
| 5,470,264 | A | 11/1995 | Eick | 440/83 |
| 5,692,992 | A | 12/1997 | Arvidsson et al. | 477/101 |
| 5,700,168 | A | 12/1997 | Mondek et al. | 440/1 |
| 5,708,216 | A | 1/1998 | Garshelis | 73/862.335 |
| 6,102,830 | A | 8/2000 | Tsutsui et al. | 477/143 |
| 6,301,976 | B1 | 10/2001 | Bogdanov | 73/862.333 |
| 6,467,360 | B1 | 10/2002 | Bogdanov | 73/862.333 |
| 6,490,934 | B2 | 12/2002 | Garshelis | 73/862.336 |
| 6,544,083 | B1 | 4/2003 | Sawyer et al. | 440/75 |
| 6,598,491 | B2 | 7/2003 | Opie et al. | 73/862.333 |

OTHER PUBLICATIONS

"The New Standard for Torque Sensing", by Magnetoelastic Devices, Inc., Copyright 1998, pp. 1–17.

*Primary Examiner*—Jesus D. Sotelo
(74) *Attorney, Agent, or Firm*—William D. Lanyi

(57) ABSTRACT

A shifting apparatus for a marine propulsion device incorporates a magnetoelastic elastic sensor which responds to torque exerted on the shift shaft of the gear shift mechanism. The torque on the shift shaft induces stress which changes the magnetic characteristics of the shift shaft material and, in turn, allows the magnetoelastic sensor to provide appropriate output signals representative of the torque exerted on the shift shaft. This allows a microprocessor to respond to the onset of a shifting procedure rather than having to wait for actual physical movement of the components of the shifting device.

26 Claims, 2 Drawing Sheets

METHOD FOR CONTROLLING A SHIFT PROCEDURE FOR A MARINE PROPULSION SYSTEM

BACKGROUND OF THE INVENTION

1. Field of the Invention

The present invention is generally related to a marine propulsion shift procedure and, more particularly, to a method for providing a shift interrupt system that requires little or no actual rotation of shift assembly components in order to provide a signal that a shift operation is beginning.

2. Description of the Prior Art

In various types of equipment powered by internal combustion engines, it is beneficial to sense the initiation of a gear shift operation and take steps to interrupt the operation of the engine during the shifting procedure. The shift interrupt process reduces the effort necessary to accomplish the gear shift operation by momentarily reducing the forces on the gear shift apparatus. One application where a shift interrupt procedures is used is in conjunction with a marine propulsion system.

U.S. Pat. No. 5,470,264, which issued to Eick on Nov. 28, 1995, discloses a marine drive shift shaft mounting system. A device is provided for isolating a shift shaft extending through an exhaust passage of a bell housing in a marine drive system. The device includes an elongated sleeve for receiving the shift shaft therein. The sleeve has a first portion sealably mounted in a first bore extending through the top wall of the exhaust passage and a second portion sealably mounted in a second bore which extends through the bottom wall of the exhaust passage. The elongated sleeve prevents galvanic corrosion and erosion of the aluminum housing and the stainless steel shaft.

U.S. Pat. No. 6,544,083, which issued to Sawyer et al. on Apr. 8, 2003, discloses a shift mechanism for a marine propulsion system. A gear shift mechanism is provided in which a cam structure comprises a protrusion which is shaped to extend into a channel formed in a cam follower structure. The cam follower structure can be provided with first and second channels that allow the protrusion of the cam to be extended into either channel which accommodates both port and starboard shifting mechanisms. The cam surface formed on the protrusion of the cam moves in contact with a selected cam follower surface formed in the selected one of two alternative channels to cause the cam follower to move axially and to cause a clutch member to engage with either a first or second drive gear.

U.S. Pat. No. 5,052,958, which issued to Entringer et al. on Oct. 1, 1991, discloses a marine drive with easier shifting. The drive has a driveshaft housing including a bell housing with an exhaust passage therethrough directing exhaust gas and cooling water, and a shift shaft extending through the exhaust passage and journaled in the bell housing by a bushing in a bore in a section of the bell housing. The interface of the bushing and the bore is subject to corrosion from exhaust gas and cooling water. Shifting is eased by enabling a portion of the bushing to contract radially inwardly toward the shift shaft due to the noted corrosion, without binding the shift shaft and otherwise impeding rotation thereof.

U.S. Pat. No. 6,102,830, which issued to Tsutsui et al. on Aug. 15, 2000, describes a shift control device for an automatic transmission. When a shift to a second gear ratio is determined during a shift control for a first shift, the process status, or circumstances, of the first shift is determined using a hydraulic pressure for a fourth brake being engaged at the determination. When the process status, that is, the process circumstances, is in an early phase, the first shift is interrupted and shift control for the direct shift to the second ratio is performed. When the process status is in a late phase, the first shift control is continued, and after ending of the first shift control, the control for the shift to the second gear ratio is performed. In the case of power off state, the second shift pattern is performed irrespective of the process status.

U.S. Pat. No. 4,753,618, which issued to Entringer on Jun. 28, 1988, discloses a shift cable assembly for a marine drive. A shift cable assembly for a marine drive includes a shift plate, a shift lever pivotally mounted on the plate, and a switch actuating arm pivotally mounted on the plate between a first neutral position and a second switch actuating position. A control cable and drive cable interconnect the shift lever and switching actuating arm with a remote control and clutch and gear assembly for the marine drive so that shifting of the remote control by a boat operator moves the cables to pivot the shift lever and switch actuating arm which in turn actuates a shift interrupter switch mounted on the plate to momentarily interrupt ignition of the drive unit to permit easier shifting into forward, neutral and reverse gears. A spring biases the arm into its neutral position is and the arm includes an improved mounting for retaining the spring in its proper location on the arm.

U.S. Pat. No. 4,432,734, which issued to Bland et al. on Feb. 21, 1984, describes a marine propulsion device including ignition interruption means to assist transmission shifting. Shifting a marine propulsion device transmission drivingly connecting a drive shaft to an internal combustion engine and including a rotatable member operable to shift the transmission between forward drive, reverse drive and neutral positions in response to rotation of a shift lever is assisted by an arrangement including a pin or element pivotally connected to a push-pull assembly operated by a main control and carried by the shift lever. The shift assistance arrangement includes a spring which retains the element in a normal position relative to the shift lever when shift resistance to movement of the transmission from an "in gear" to the neutral position is less than a predetermined level and permits displacement of the element relative to the shift lever from the normal position when the shift resistance is above that predetermined level. The shift assistance arrangement also includes a switch operable when actuated to selectively interrupt engine ignition. This switch is carried on the shift lever and is s actuated to interrupt engine ignition in response to displacement of the element from the normal position.

U.S. Pat. No. 4,262,622 which issued to Dretzka et al. on Apr. 21, 1981, describes a marine propulsion device including ignition interruption means to assist transmission shifting. The marine propulsion device includes an internal combustion engine and a reversing transmission having a pair of bevel gears and a clutch dog movable between a neutral position out of engagement with the bevel gears and forward and reverse drive positions in full engagement with one of the bevel gears. The marine propulsion device also includes a shift assistance arrangement included in a shift mechanism for axially moving the clutch dog between the neutral and drive positions, and which includes a load sensing lost motion shift lever arrangement having a first switch which is actuated when the resistance to axially moving the clutch dog into a drive position exceeds an upper limit.

U.S. Pat. No. 5,700,168, which issued to Mondek et al. on Dec. 23, 1997, describes an electronic ignition interruption apparatus. A shift interrupt apparatus for a marine drive of the type which has an ignition system and a transmission that is adapted to be selectively shifted among forward, neutral and reverse operating positions is described. A control member is provided for selectively positioning the transmission of the drive into forward, neutral and reverse operating positions. The apparatus has a light circuit associated with the mechanical assembly adapted to detect excessive shifting force, which generates an electrical signal for interrupting the ignition to facilitate easier shifting.

U.S. Pat. No. 5,708,216, which issued to Garshelis on Jan. 13, 1998, describes a circularly magnetized non-contact torque sensor and method for measuring torque using the sensor. A torque sensor for providing an output signal indicative of the torque applied to a rotating torqued member comprises a magnetoelastically active element for producing a magnetic field varying with the applied torque and a field modulating means for modulating the magnetic field in a periodic manner which is indicative of the speed of member rotation. A magnetic field vector sensor, such as a Hall effect sensor, senses the amplitude of the modulated field for providing an output signal which is linearly indicative of the lo torque applied to the rotating member.

U.S. Pat. No. 6,490,934, which issued to Garshelis on Dec. 10, 2002, describes a circularly magnetized non-contact torque sensor and method for measuring torque using the sensor. The sensor is indicated for providing an output signal indicative of the torque applied to a member and includes a ferromagnetic, magnetostrictive, magnetoelastically active region on or in the member, the region being proportionally subjected to the torque applied to the member. The region is endowed with an effective uniaxial magnetic anisotropy having the circumferential direction as the easy axis and is magnetically polarized in a single circumferential direction. When torque is applied to the member, the magnetoelastically active region produces a magnetic field varying with the torque, which field is sensed by magnetic field sensors arranged proximate the region.

U.S. Pat. No. 6,301,976, which issued to Bogdanov on Oct. 16, 2001, describes a torque sensing apparatus having a magnetoelastic member secured to a shaft. A shaft experiences torsion about its axis in response to an applied torque. A cylindrical magnetoelastic member is secured coaxially about the shaft. The magnetoelastic member has first and second spaced apart end portions. Each end portion is chamfered at a predetermined angle with respect to a plane extending perpendicular to the shaft axis. The magnetoelastic member provides a magnetic field in response to the torsion of the shaft. A detector is positioned adjacent to the magnetoelastic member for sensing the magnetic field and providing a signal indicative of the applied torque.

U.S. Pat. No. 5,692,992, which issued to Arvidsson et al. on Dec. 2, 1997, describes a shift assist and engine interrupter apparatus. The apparatus includes a tube having a pair of biased springs, between which a sleeve at the end of a transmission cable is movably retained. A remote control cable is fixedly attached to the tube. High transmission cable shift forces associated with resistance to shifting caused the sleeve to move against the bias of one of the springs. A sensor detects this movement and sends an electrical signal to interrupt the engine ignition circuit, thereby preventing the firing of one or more cylinders of the engine. The interruption of the engine ignition reduces the torque on the shift mechanism, in turn reducing the shift forces in the transmission cable and enabling the operator to shift the transmission. When the shift operation is completed, the engine resumes normal firing.

U.S. Pat. No. 4,762,008, which issued to Kobayashi et al. on Aug. 9, 1988, describes a torque detecting apparatus. The apparatus utilizes a magnetoelastic effect comprising one or more pairs of thin magnetic metal strips affixed to a torque-transmitting shaft subjected to torque detection and having a magnetic anisotropy induced in a predetermined direction, and one or more pairs of detecting cores paired with the above one or more pairs of thin magnetic metal strips, fixed in contact with the thin magnetic metal strips, each of the cores of the one or more pairs of detecting cores having a detecting coil wound therearound. In one embodiment, the torque detecting apparatus utilizes a magnetoelastic effect of thin magnetic metal strip wherein the absolute value of saturated magnetostriction constant of the thin magnetic metal strip is less than $1\times10^{-6}$.

U.S. Pat. No. 6,467,360, which issued to Bogdanov on Oct. 22, 2002, describes a torque sensing apparatus and method. The torque sensing apparatus is used for sensing torque applied to an elongated shaft having a longitudinal axis. An elongated magnetoelastic element is connected about a portion of the shaft. The magnetoelastic element provides a magnetic field in response to a torque applied to the shaft. The magnetic member is positioned adjacent the magnetoelastic element. An alternating power source drives the magnetic member into magnetic saturation. The magnetic member has a saturation condition responsive to the magnetic field of the magnetoelastic element. A detector circuit detects the saturation condition of the magnetic member. The detector circuit provides a signal indicative of the applied torque in response to the saturation condition of the magnetic member.

U.S. Pat. No. 6,598,491, which issued to Opie et al. on Jul. 29, 2003, describes a magnetoelastic torque sensor. The sensor is intended for measuring the magnitude of torque applied to a member, comprising a magnetoelastic element which is disposed on and encircles the member, an outer flux guide extending across the magnetoelastic element in an axial direction and adjacent to the opposite end regions thereof, and an inner flux guide located between the first and second end regions, wherein the inner and outer flux guides provide a magnetic path to an axial component of the magnetic field produced by the magnetoelastic element in response to a non-zero value of torque.

The patents described above are hereby expressly incorporated by reference in the description of the present invention.

A pamphlet titled "The New Standard for Torque Sensing" is provided by the Magnetoelastic Devices Corporation. It describes the technology relating to magnetoelastic sensing, compares this technology to other types of torque sensors, and discusses its principals of operation. In addition to describing the theory behind magnetoelastic sensing, this pamphlet also provides examples of how magnetoelastic sensing can be applied in various industries.

In a shift interruption system, one inherent problem is that sensing the initiation of the shifting procedure requires that the shifting apparatus actually move from a resting position. In known sensing systems, this is necessary because physical movement of the shifting apparatus is necessary in order to actuate a switch or sensor that is used to determine the onset of a shifting procedure so that the internal combustion engine associated with the apparatus can be interrupted. Because of the necessity of this actual movement of the shifting apparatus, a certain amount of lost motion occurs before the shifting process can be sensed and any interrupting process can begin. This, in turn, limits the timeliness of the interruption procedure. It would therefore be significantly beneficial if a method could be determined which allows the shift interruption procedure to begin more quickly upon the initial onset of the shifting process by the operator of a vehicle, such as a marine vessel. In other words, it would be beneficial if the onset of the shift procedure could be sensed immediately when the operator of the vehicle begins to move a shift lever from its resting position to a new position.

SUMMARY OF THE INVENTION

A method for controlling a shift procedure for a marine propulsion system, in accordance with the preferred embodiment of the present invention, comprises the steps of providing a shaft incorporated as part of a shifting apparatus of the marine propulsion system and sensing a change of the magnetic characteristic of the shaft in response to a force exerted on the shaft. It also comprises the step of determining the occurrence of a gear shift operation as a function of the change of the magnetic characteristic of the shaft.

The force, in a preferred embodiment of the present invention, results in a torque exerted on the shaft and the magnetic characteristic changes as a function of the torque. The shaft is rotatable about a central axis. The present invention can further comprise the step of affecting the operation of an engine based on the change of the magnetic characteristic of the shaft. The present invention comprises the step of providing a magnetoelastic sensor associated with the shaft to perform the sensing step. The magnetoelastic sensor can be attached to the shaft. The magnetoelastic sensor can be attached to a stationary portion of the marine propulsion system proximate to and disconnected from the shaft.

The present invention further comprises the step of providing a microprocessor and providing a signal to the microprocessor which is representative of the change in magnetic characteristic of the shaft. It can further comprise the step of providing a signal from the microprocessor to the engine to effect an operation of the engine in response to the change in the magnetic characteristic of the shaft. The shaft, in a preferred embodiment of the present invention, is a shift shaft. The method of the present invention can further comprise the step of determining the initiation of a shifting operation as a function of the change of the magnetic characteristic of the shaft.

An apparatus made in accordance with the preferred embodiment of the present invention comprises a shift shaft incorporated as part of a shifting apparatus of the marine propulsion system and a sensor configured to sense a change in the magnetic characteristic of the shift shaft in response to a force exerted on the shift shaft. The sensor provides an output signal representative of the change in the magnetic characteristic of the shift shaft.

The force results in a torque exerted on the shift shaft and the magnetic characteristic changes as a function of the torque. A microprocessor is connected in signal communication with the sensor and provides an output signal which is connected to an engine to effect the operation of the engine based on the change of the magnetic characteristic of the shift shaft. The sensor is a magnetoelastic sensor, in a preferred embodiment of the present invention, and the sensor is associated with the shift shaft. The magnetoelastic sensor can be attached to the shift shaft. The magnetoelastic sensor can be attached to a stationary portion of the marine propulsion system proximate to and disconnected from the shift shaft.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 2:
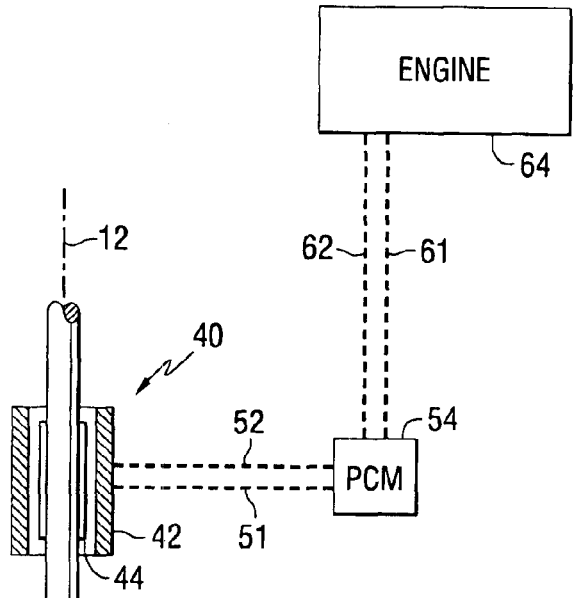
FIG. 2 is a schematic representation of an apparatus made in accordance with a preferred embodiment of the present invention.

Throughout the description of the preferred embodiment of the present invention, like components will be identified by like reference numerals.

Figure 1:
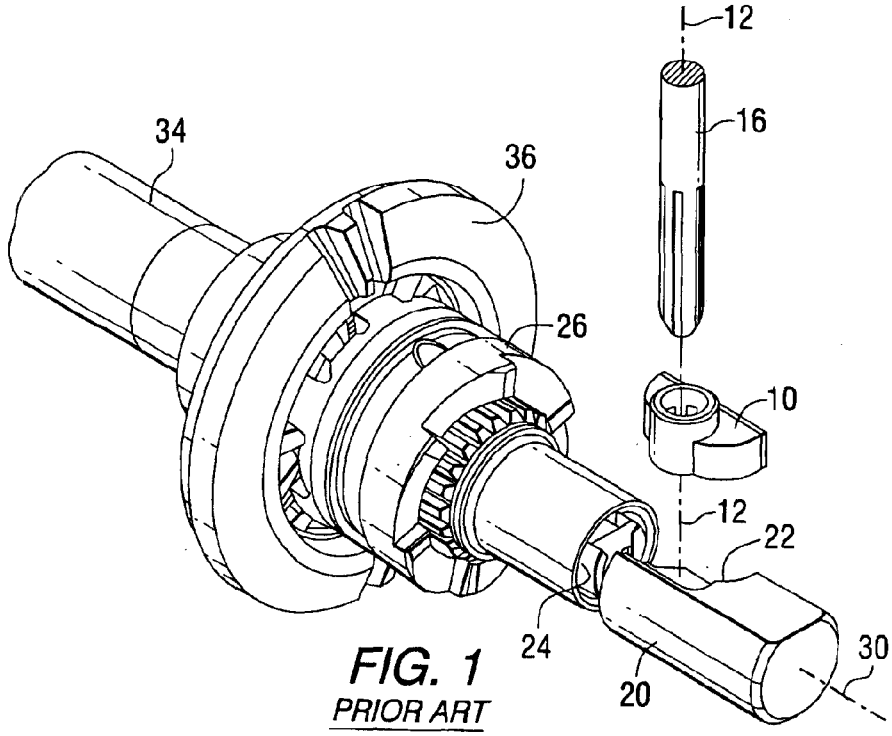
FIG. 1 PRIOR ART
FIG. 1 shows a known structure associated with a shifting device of a marine propulsion system.

The shift mechanism shown in FIG. 1 is generally well known to those skilled in the art. It is a desmodromic shift mechanism. A cam 10 is rotatable about an axis 12 in response to rotation of a shift shaft 16. A cam follower 20 has a cam surface 22 formed in it. The cam follower 20 is connected to an actuator 24 which, in turn, is connected to the clutch member 26 to cause the clutch member to move in an axial direction generally parallel to axis 30. The output shaft 34 and a drive gear 36 are also shown in FIG. 1. The assembly shown in FIG. 1 is familiar to those skilled in the art of marine gear shift mechanisms. It illustrates one application of a shift shaft 16 and how it operates by rotating about its central axis 12.

As described above, several devices are well known to those skilled in the art of gear shift mechanism for marine propulsion systems. These include the systems described in U.S. Pat. Nos. 4,753,618 and 4,432,734. In addition, U.S. Pat. No. 5,700,168 describes a mechanism that uses a light beam to detect rotation of the shift shaft 16. As it well understood by those skilled in the art, the detection of a shifting procedure is often used in order to actuate a shift interruption process that inhibits the ignition of an engine in order to reduce the overall forces existing within the mechanism of the shifting device in order to make the shifting procedure easier.

All of the shift interruption sensors described above and known to those skilled in the art require movement of components within the shifting system in order for a sensor or switch to be actuated. It would be significantly beneficial if the initiation or onset of a gear shifting procedure could be sensed prior to, or simultaneous with, the actual shifting maneuver. In other words, when an operator of a marine vessel initially begins to move the manually controlled throttle and shift lever, which is normally located at the helm, it would be beneficial if a virtually instantaneous sensing of that action could be performed so that the shift interrupting process could occur virtually simultaneously with the beginning of the shifting procedure.

FIG. 2 is a highly schematic representation of a system incorporating the concepts of the present invention.

In FIG. 2 a magnetoelastic sensor 40 comprises a stationary portion 42 and a rotatable portion 44 that is attached to the shift shaft 16. In a manner that is generally familiar to those skilled in the art of magnetoelastic sensing, torque applied to the shift shaft 16 will cause a change in its magnetic characteristic which is able to be sensed by the magnetoelastic sensor 40. A signal is provided, on lines 51 and 52, to a microprocessor which is incorporated as part of a propulsion control module 54. The propulsion control module compares the signal received on lines 51 and 52 to a threshold magnitude which allows it to determine whether or not the signal from the magnetoelastic sensor 40 is sufficient to indicate that the torque exerted on the shift shaft 16 indicates that a shifting operation is beginning. In other words, when the operator of the vehicle institutes a shifting operation, by beginning to move the throttle and shift lever, the shift shaft 16 is urged to rotate about its central axis 12. Prior to actual rotation of the shift shaft 16 about its axis 12, torque induces stress in the shift shaft 16 which is sufficient to change its magnetic characteristic. This change in magnetic characteristic is sensed by the magnetoelastic sensor 40 and signals are provided, on lines 51 and 52, which are representative of the magnitude of that torque. When the propulsion control module 54 determines that a shifting operation has begun, in response to receiving the signals on lines 51 and 52, it can provide appropriate signals, on lines 61 and 62, to cause the engine 64 to have its operation interrupted. In other words, the ignition system associated with the engine 64 can be disrupted to prevent the firing of certain spark plugs of the engine 64. As a result, the imposed forces on the shifting mechanism are decreased. This shift interrupting procedure is well known to those skilled in the art and will not be described in detail herein. It should be understood that the advantages of the present invention relate to the sensing of the onset of a shifting procedure and are not limited by the precise methods used to interrupt the operation of the engine 64.

Figure 3:
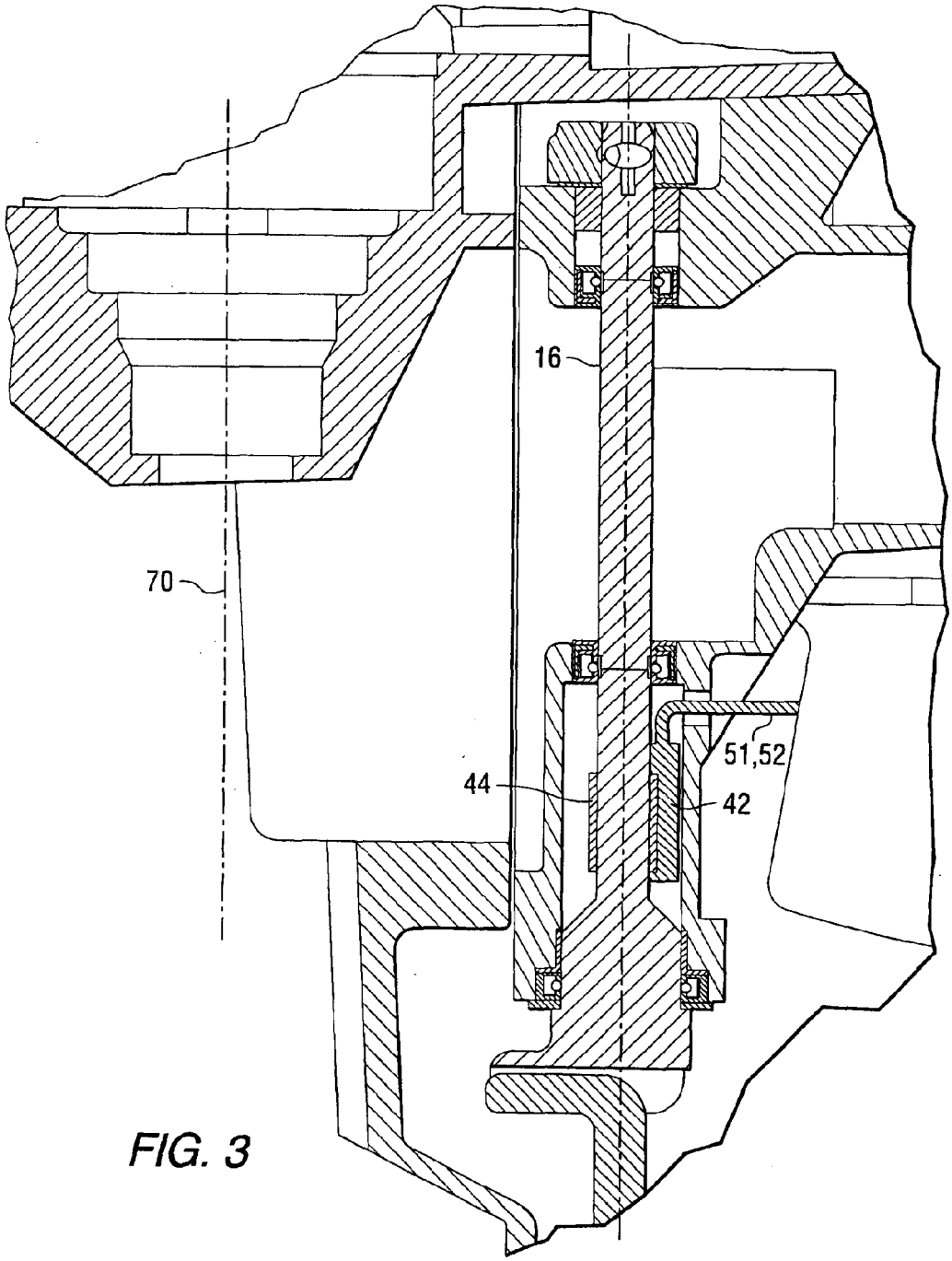
FIG. 3 is a section view of a portion of a marine propulsion system showing the shift shaft and an associated magnetoelastic sensor.

FIG. 3 is a partial section view of a portion of a marine propulsion system showing the location of a shift shaft 16 in relation to the center line 70 of the drive shaft of the marine propulsion system which is rotatable about its vertical axis as shown. Since the operation of the shift shaft 16 in marine propulsion systems is well known to those skilled in the art and described in detail in U.S. Pat. Nos. 5,470,264 and 6,544,083, the overall structure of the shifting apparatus will not be described in detail. However, the shift shaft 16 is shown in FIG. 3 with the magnetoelastic sensor associated with it. The rotatable portion 44 and the stationary portion 42 are shown with the electrical leads, 51 and 52, contained in a sheath extending from the stationary portion 42.

The method of the present invention comprises the steps of providing the shift shaft 16 which is incorporated as part of a shifting apparatus of a marine propulsion system. It also comprises the step of sensing a change in the magnetic characteristics of the shaft 16 in response to a force exerted on the shaft. In a typical application, the force results in a torque on the shaft 16 about central axis 12. Signals provided by the magnetoelastic sensor 40 allow the microprocessor of the propulsion control module 54 to determine the occurrence of the onset of a gear shift operation as a function of the change of the magnetic characteristic of the shaft prior to actual movement of the shaft 16. In other words, prior to or simultaneous with the physical rotation of the shift shaft 16 about its central axis 12, a torque causes changes in the stress experienced by the shaft 16. These changes in stress affect the magnetic characteristics of the shaft 16 and these changes are sensed by the magnetoelastic sensor 40. Representative signals are provided, on lines 51 and 52, to the microprocessor of the propulsion control module 54 and these signals allow the microprocessor to determine when an actual shifting procedure is beginning. By responding to the torque on the shaft 16 rather than actual physical movement of the shaft 16, the microprocessor is able to respond much more quickly than if actual movement was used to activate a switch or sensor.

Although the present invention has been described with particular specificity and illustrated to show a preferred embodiment, it should be understood that alternative embodiments are also within its scope.

We claim:

1. A method for controlling a shift procedure for a marine propulsion system, comprising the steps of:

providing a shaft incorporated as part of a shifting apparatus of said marine propulsion system;

sensing a change of the magnetic characteristic of said shaft in response to a force exerted on said shaft; and determining the occurrence of a gear shift operation as a function of said change of the magnetic characteristic of said shaft.

2. The method of claim 1, wherein:

said force results in a torque exerted on said shaft.

3. The method of claim 2, wherein:

said magnetic characteristic changes as a function of said torque.

4. The method of claim 1, wherein:

said shaft is rotatable about a central axis.

5. The method of claim 1, further comprising:

affecting the operation of an engine based on said change of said magnetic characteristic of said shaft.

6. The method of claim 1, further comprising:

providing a magnetoelastic sensor associated with said shaft to perform said sensing step.

7. The method of claim 6, wherein:

said magnetoelastic sensor is attached to said shaft.

8. The method of claim 6, wherein:

said magnetoelastic sensor is attached to a stationary portion of said marine propulsion system proximate to and disconnected from said shaft.

9. The method of claim 1, further comprising:

providing a microprocessor.

10. The method of claim 9, further comprising:

providing a signal to said microprocessor which is representative of said change in the magnetic characteristic of said shaft.

11. The method of claim 10, further comprising:

providing a signal from said microprocessor to said engine to affect an operation of said engine in response to said change in the magnetic characteristic of said shaft.

12. The method of claim 1, wherein:

said shaft is a shift shaft.

13. The method of claim 1, further comprising:

determining the initiation of a shifting operation as a function of said change of the magnetic characteristic of said shaft.

14. Apparatus for controlling a shift procedure for a marine propulsion system, comprising:

means for providing a shaft incorporated as part of a shifting apparatus of said marine propulsion system;

means for sensing a change of the magnetic characteristic of said shaft in response to a force exerted on said shaft; and means for determining the occurrence of a gear shift operation as a function of said change of the magnetic characteristic of said shaft.

15. The apparatus of claim 14, further comprising:

means for affecting the operation of an engine based on said change of said magnetic characteristic of said shaft.

16. The apparatus of claim 15, further comprising:

means for providing a magnetoelastic sensor associated with said shaft to perform said sensing step.

17. The apparatus of claim 16, further comprising:

means for providing a microprocessor.

18. The apparatus of claim 17, further comprising:

means for providing a signal to said microprocessor which is representative of said change in the magnetic characteristic of said shaft.

19. The apparatus of claim 18, further comprising:

means for providing a signal from said microprocessor to said engine to affect an operation of said engine in response to said change in the magnetic characteristic of said shaft.

20. The apparatus of claim 19, further comprising:

means for determining the initiation of a shifting operation as a function of said change of the magnetic characteristic of said shaft.

21. An apparatus for controlling a shift procedure for a marine propulsion system, comprising:

a shift shaft incorporated as part of a shifting apparatus of said marine propulsion system; and a sensor configured to sense a change of the magnetic characteristic of said shift shaft in response to a force exerted on said shift shaft, said sensor providing an output signal representative of said change of the magnetic characteristic of said shift shaft.

22. The apparatus of claim 21, wherein:

said force results in a torque exerted on said shift shaft, said magnetic characteristic changing as a function of said torque.

23. The apparatus of claim 22, further comprising:

a microprocessor connected in signal communication with said sensor, said microprocessor providing an output signal which is connected to an engine to affect the operation of said engine based on said change of said magnetic characteristic of said shift shaft.

24. The apparatus of claim 23, wherein:

said sensor is a magnetoelastic sensor associated with said shift shaft.

25. The apparatus of claim 24, wherein:

said magnetoelastic sensor is attached to said shift shaft.

26. The apparatus of claim 24, wherein:

said magnetoelastic sensor is attached to a stationary portion of said marine propulsion system proximate to and disconnected from said shift shaft.

* * * * *